US010741162B1

(12) United States Patent
Bastyr

(10) Patent No.: US 10,741,162 B1
(45) Date of Patent: Aug. 11, 2020

(54) STORED SECONDARY PATH ACCURACY VERIFICATION FOR VEHICLE-BASED ACTIVE NOISE CONTROL SYSTEMS

(71) Applicant: Harman International Industries, Incorporated, Stamford, CT (US)

(72) Inventor: Kevin J. Bastyr, Franklin, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/459,844

(22) Filed: Jul. 2, 2019

(51) Int. Cl.
*G10K 11/178* (2006.01)

(52) U.S. Cl.
CPC .. *G10K 11/17817* (2018.01); *G10K 11/17823* (2018.01); *G10K 11/17825* (2018.01); *G10K 11/17833* (2018.01); *G10K 11/17881* (2018.01)

(58) Field of Classification Search
CPC ..... G10K 11/17817; G10K 11/17883; G10K 11/17885; G10K 11/17881
USPC ..... 381/71.11
See application file for complete search history.

(56) References Cited

U.S. PATENT DOCUMENTS

| | | | | |
|---|---|---|---|---|
| 10,347,236 | B1 * | 7/2019 | Bastyr | G10K 11/17854 |
| 2009/0086990 | A1 * | 4/2009 | Christoph | H04R 3/04 381/71.12 |
| 2010/0014685 | A1 * | 1/2010 | Wurm | G10K 11/17881 381/71.11 |
| 2010/0195844 | A1 * | 8/2010 | Christoph | G10K 11/17817 381/71.11 |
| 2013/0204617 | A1 * | 8/2013 | Kuo | H04R 3/002 704/233 |
| 2019/0270350 | A1 * | 9/2019 | Bastyr | B60C 23/062 |

* cited by examiner

*Primary Examiner* — Paul Kim
*Assistant Examiner* — Ubachukwu A Odunukwe
(74) *Attorney, Agent, or Firm* — Brooks Kushman P.C.

(57) ABSTRACT

An active noise cancellation (ANC) system may include provisions for validating the accuracy of a modeled transfer characteristic stored in secondary path filters, which provides an estimate of the secondary path (i.e., the transfer function between a speaker and an error microphone). Using estimated anti-noise or music signals to adjust an error signal from the error microphone, a signal analysis controller may detect ANC instability or noise boosting. Such noise boosting may indicate the stored transfer characteristic in the secondary path filter does not accurately represent the actual secondary path. According, upon detection of noise boosting, the stored transfer characteristic of the secondary path filters may be modified.

12 Claims, 4 Drawing Sheets

400

| RPM | 2nd | 4th | 6th | 8th |
|---|---|---|---|---|
| 500 | 17 | 33 | 50 | 67 |
| 750 | 25 | 50 | 75 | 100 |
| 1000 | 33 | 67 | 100 | 133 |
| 1250 | 42 | 83 | 125 | 167 |
| 1500 | 50 | 100 | 150 | 200 |
| 1750 | 58 | 117 | 175 | 233 |
| 2000 | 67 | 133 | 200 | 267 |
| 2250 | 75 | 150 | 225 | 300 |
| 2500 | 83 | 167 | 250 | 333 |
| 2750 | 92 | 183 | 275 | 367 |
| 3000 | 100 | 200 | 300 | 400 |
| 3600 | 120 | 240 | 360 | 480 |
| 4000 | 133 | 267 | 400 | 533 |
| 5000 | 167 | 333 | 500 | 667 |
| 6000 | 200 | 400 | 600 | 800 |

STORED SECONDARY PATH ACCURACY VERIFICATION FOR VEHICLE-BASED ACTIVE NOISE CONTROL SYSTEMS

TECHNICAL FIELD

The present disclosure is directed to an active noise cancellation system and, more particularly, to verifying the accuracy of secondary path filters in a feedforward active noise control framework to prevent the occurrence of noise boosting and/or system instability.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at one or more listeners' ears. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable engine noise inside the vehicle cabin. EOC systems use a non-acoustic signal, such as a revolutions-per-minute (RPM) sensor, to generate a signal representative of the engine speed as a reference. This reference signal is used to generate sound waves that are opposite in phase to the engine noise audible in the vehicle interior. Because EOC systems use a signal from an RPM sensor, they do not require vibrations sensors.

RNC systems are typically designed to cancel broadband signals, while EOC systems are designed and optimized to cancel narrowband signals, such as individual engine orders. ANC systems within a vehicle may provide both RNC and EOC technologies. Such vehicle-based ANC systems are typically Least Mean Square (LMS) adaptive feed-forward systems that continuously adapt W-filters based on noise inputs (e.g., acceleration inputs from the vibrations sensors in an RNC system) and signals of error microphones located in various positions inside the vehicle's cabin. A feature of LMS-based feed-forward ANC systems and corresponding algorithms is the storage of the impulse response, or secondary path, between each error microphone and each anti-noise speaker in the system. The secondary path is the transfer function between an anti-noise generating speaker and an error microphone, essentially characterizing how an electrical anti-noise signal becomes sound that is radiated from the speaker, travels through a vehicle cabin to an error microphone, and becomes the microphone output signal.

ANC systems employ modeled transfer characteristics, which estimate the various secondary paths, in the adapting the W-filters. Noise cancellation performance degradation, noise gain, or actual instability can result if the modeled transfer characteristic of the secondary path stored in the ANC system differs from the actual secondary path within the vehicle. The actual secondary path may deviate from the stored secondary path model, typically measured on a "golden system" by trained engineers, when a vehicle becomes substantially different from the reference vehicle or system in terms of geometry, passenger count, luggage loading, or the like. Other differences could include or speaker or microphone unit-to-unit variation, aging, or failure, non-identical speaker replacement or wiring errors.

SUMMARY

In one or more illustrative embodiments, a method for controlling stability in an active noise cancellation (ANC) system is provided. The method may include receiving an error signal from a microphone and generating a speaker signal to be radiated from a speaker. The speaker signal may include at least a music signal. The method may further include filtering the music signal using a secondary path filter to obtain an estimated music signal. The secondary path filter may be defined by a stored transfer characteristic that estimates a secondary path between the speaker and the microphone. The method may further include modifying the error signal using the estimated music signal to obtain an adjusted error signal and detecting an occurrence of noise boosting based on a comparison of the error signal to the adjusted error signal.

Implementations may include one or more of the following features. For instance, modifying the error signal using the estimated music signal to obtain an adjusted error signal may comprise subtracting the estimated music signal from the error signal to obtain the adjusted error signal when the error signal contains music. Further, detecting an occurrence of noise boosting based on a comparison of the error signal to the adjusted error signal may include detecting the occurrence of noise boosting when energy in the adjusted error signal exceeds energy in the error signal. As another example, detecting an occurrence of noise boosting based on a comparison of the error signal to the adjusted error signal may include detecting the occurrence of noise boosting when energy in the error signal does not exceed energy in the adjusted error signal by a predetermined threshold. In certain embodiments. the speaker signal may further comprise an anti-noise signal. Moreover, the method may further include deactivating the speaker signal in response to detecting an occurrence of noise boosting.

The secondary path filter may be further used to filter a noise signal from a sensor to obtain a filtered noise signal. An adaptive filter controller may be configured to control an adaptive transfer characteristic based on the filtered noise signal and the error signal. A controllable filter may be configured to generate an anti-noise signal based on the adaptive transfer characteristic and the noise signal. In this manner, the method may further include deactivating the anti-noise signal in response to detecting an occurrence of noise boosting. Alternatively, the method may further include modifying the stored transfer characteristic in the secondary path filter in response to detecting an occurrence of noise boosting. Modifying the stored transfer characteristic may include substituting the stored transfer characteristic with another transfer characteristic that provides a different estimate of the secondary path between the speaker and the microphone.

One or more additional embodiments may be directed to an ANC system. The ANC system may include a first secondary path filter configured to filter a noise signal received from a sensor to obtain a filtered noise signal. The first secondary path filter may be defined by a stored transfer characteristic that estimates a secondary path between a speaker and a microphone. The ANC system may further include an adaptive filter controller, including a processor and memory, programmed to control an adaptive transfer characteristic based on the filtered noise signal and an error signal received from a microphone located in a cabin of a vehicle. The ANC system may further include a controllable filter configured to generate an anti-noise signal based on the adaptive transfer characteristic and the noise signal. The ANC system may further include a signal analysis controller, including a processor and memory, programmed to: receive an adjusted error signal based on the error signal; detect an occurrence of noise boosting based on a comparison of the adjusted error signal to one of the error signal and a simulated error signal; and modify the stored transfer characteristic in the first secondary path filter in response to detecting an occurrence of noise boosting.

Implementations may include one or more of the following features. The signal analysis controller may be programmed to detect noise boosting when energy in the error signal exceeds energy in the adjusted error signal or when energy in the adjusted error signal does not exceed energy in the error signal by a predetermined threshold. The adjusted error signal may be obtained by filtering the anti-noise signal using a second secondary path filter to obtain an estimated anti-noise signal and then subtracting the estimated anti-noise signal from the error signal when the error signal contains anti-noise. The second secondary path filter may be a copy of the first secondary path filter.

Alternatively, the signal analysis controller may be programmed to detect noise boosting when energy in the adjusted error signal exceeds energy in the error signal or when energy in the error signal does not exceed energy in the adjusted error signal by a predetermined threshold. The adjusted error signal may thus be obtained by filtering the anti-noise signal using a second secondary path filter to obtain an estimated anti-noise signal and then adding the estimated anti-noise signal to the error signal when the error signal lacks anti-noise. Or, the adjusted error signal may be obtained by filtering a music signal using a second secondary path filter to obtain an estimated music signal and then subtracting the estimated music signal from the error signal when the error signal contains music. Again, the second secondary path filter may be a copy of the first secondary path filter.

Further, the simulated error signal may be obtained by filtering a simulated speaker signal using a second secondary path filter, the second secondary path filter being a copy of the first secondary path filter. The simulated speaker signal may include at least one of a music signal and a simulated anti-noise signal. The simulated anti-noise signal may be obtained by filtering the noise signal with a stored adaptive transfer characteristic.

One or more additional embodiments may be directed to a computer-program product embodied in a non-transitory computer readable medium that is programmed for ANC. The computer-program product may include instructions for: receiving an error signal from a microphone; receiving a noise signal from a sensor; filtering the noise signal using a first secondary path filter to obtain a filtered noise signal, the first secondary path filter defined by a stored transfer characteristic that estimates a secondary path between a speaker and the microphone; controlling filter coefficients of a controllable filter based on the filtered noise signal and the error signal; generating an anti-noise signal to be radiated from the speaker based on the noise signal and the filter coefficients; filtering a music signal using a second secondary path filter to obtain an estimated music signal, the second secondary path filter being a copy of the first secondary path filter; subtracting the estimated music signal from the error signal to obtain an adjusted error signal; and detecting an occurrence of noise boosting based on a comparison of the error signal to the adjusted error signal.

Implementations may include one or more of the following features. The computer-program product may include further instructions for disabling the anti-noise signal from being radiated by the speaker in response to detecting an occurrence of noise boosting. The computer-program product may include further instructions for modifying the stored transfer characteristic in the first secondary path filter in response to detecting an occurrence of noise boosting. The computer-program product may include further instructions for: filtering the anti-noise signal using the second secondary path filter to obtain an estimated anti-noise signal; and subtracting the estimated anti-noise signal from the error signal to obtain the adjusted error signal.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
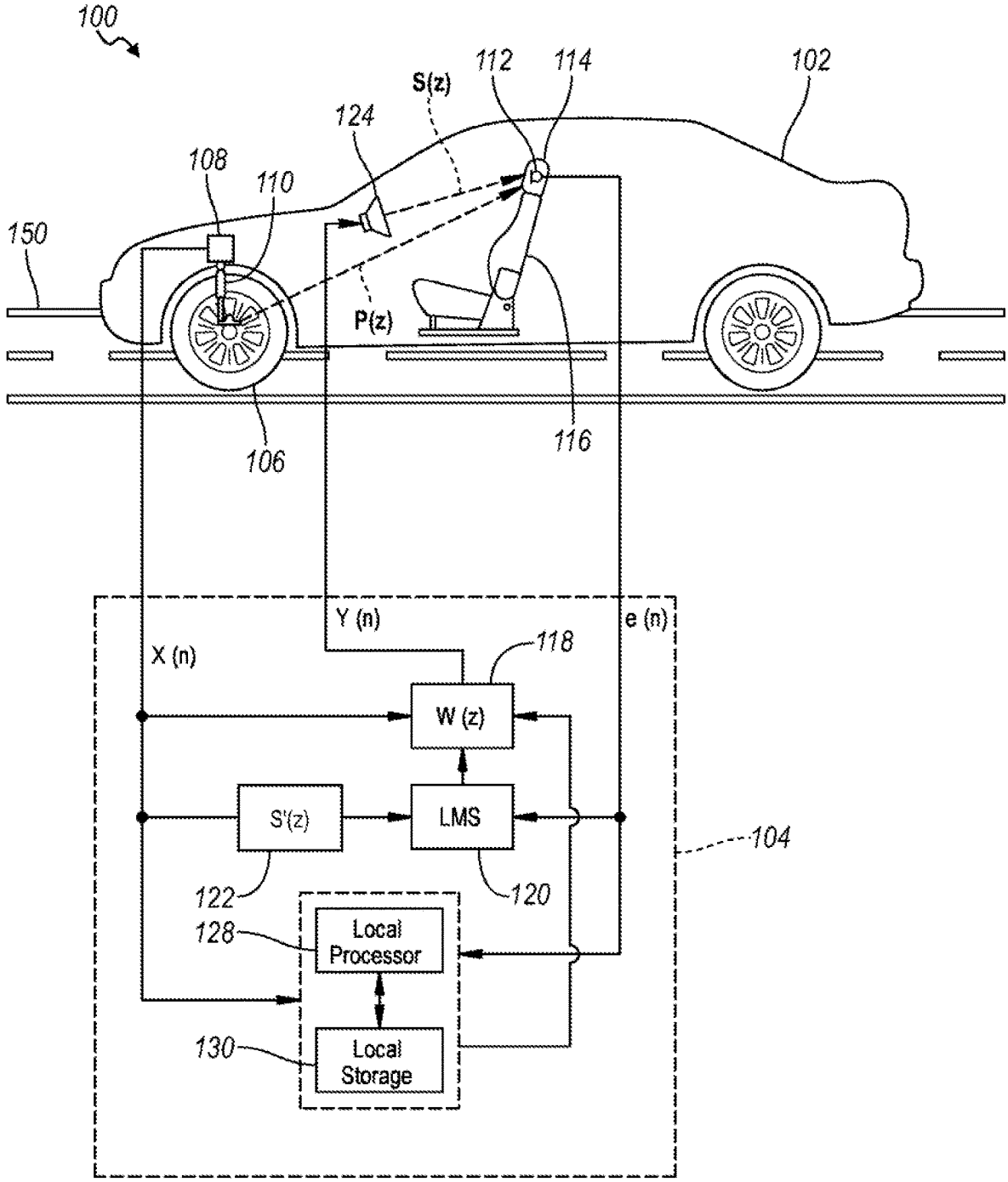
FIG. 1 is an environmental block diagram of a vehicle having an active noise control (ANC) system including a road noise cancellation (RNC), in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension, subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), microphones 112 (e.g., 4 to 6), and speakers 124 (e.g., 4 to 8).

The vibration sensors 108 may include, but are not limited to, accelerometers, force gauges, geophones, linear variable differential transformers, strain gauges, and load cells. Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those skilled in the art. In certain embodiments, a microphone may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e., the transfer function between an actual noise source and an error microphone).

The microphones 112 may output an error signal e(n) representing the noise present in the cabin of the vehicle 102 as detected by the microphones 112. In the RNC system 100, an adaptive transfer characteristic W(z) of a controllable filter 118 may be controlled by adaptive filter controller 120, which may operate according to a known least mean square (LMS) algorithm based on the error signal e(n) and the noise signal X(n) filtered with the modeled transfer characteristic S'(z) by the filter 122. The controllable filter 118 is often referred to as a W-filter. An anti-noise signal Y(n) may be generated by an adaptive filter formed by the controllable filter 118 and the adaptive filter controller 120 based on the identified transfer characteristic W(z) and the vibration signal, or a combination of vibration signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, a processor 128 may collect and optionally processes the data from the vibration sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, optimal W-filters, alternate secondary path filters S'(z), various noise boosting thresholds, accelerometer or microphone spectra or time dependent signals, and engine SPL versus Torque and RPM. In one or more embodiments, the processor 128 and storage 130 may be integrated with one or more RNC system controllers, such as the adaptive filter controller 120.

As previously described, typical RNC systems may use several vibration sensors, microphones and speakers to sense structure-borne vibratory behavior of a vehicle and generate anti-noise. The vibrations sensor may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors. Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., secondary path filters 122), which estimate the transfer function for each secondary path. As shown in FIG. 1, an RNC system will also have one W(z) filter (i.e., controllable filter 118) between each noise signal X(n) from a vibration sensor (i.e., accelerometer) 108 and each speaker 224. Accordingly, a 12-accelerometer signal, 6-speaker RNC system may have 72 W(z) filters. The relationship between the number of accelerometer signals, speakers, and W(z) filters is illustrated in FIG. 2.

Figure 2:
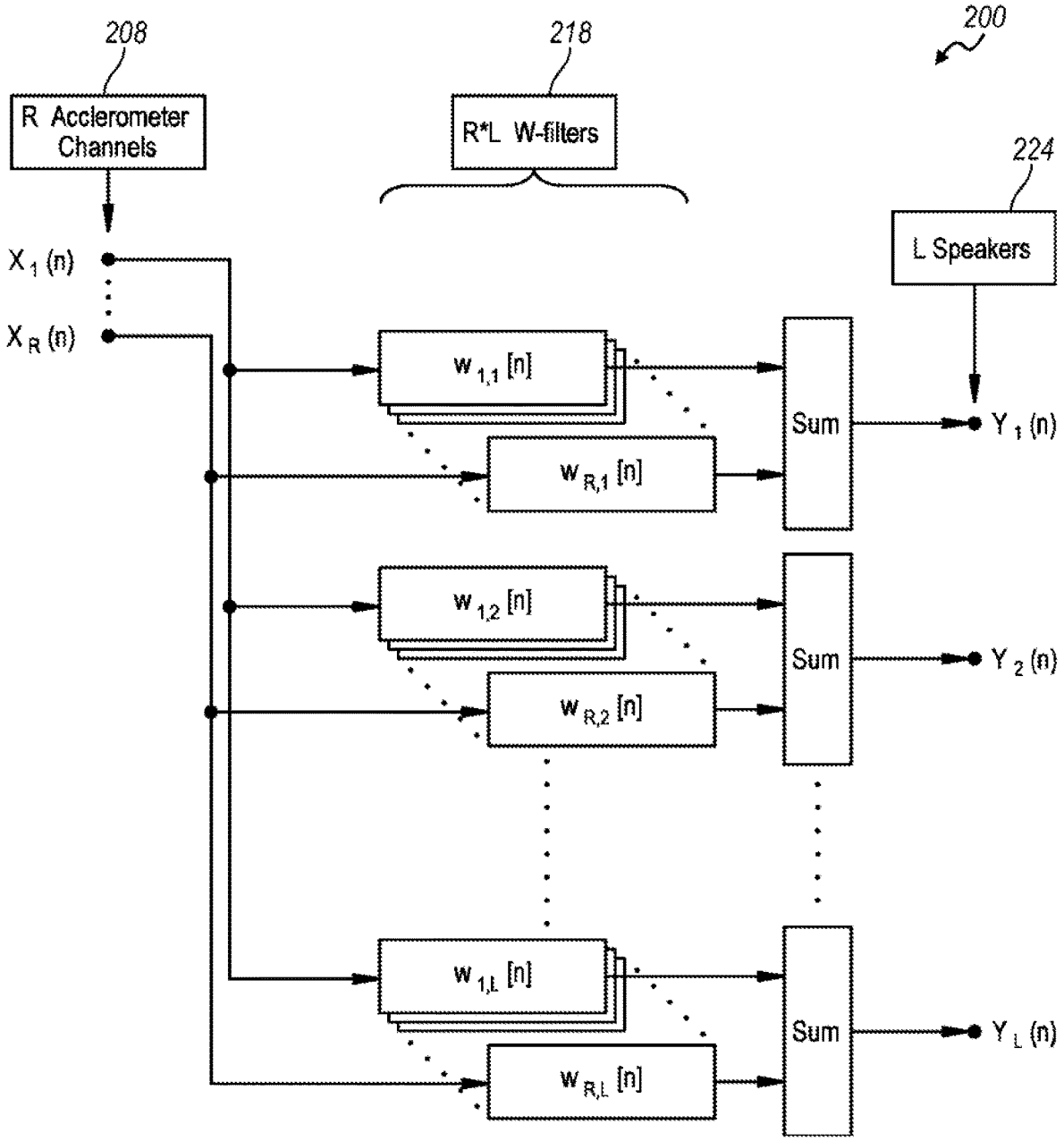
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals [$X_1(n)$, $X_2(n)$, . . . $X_R(n)$] from accelerometers 208 and L speaker signals [$Y_1(n)$, $Y_2(n)$, . . . $Y_L(n)$] from speakers 224. Accordingly, the RNC system 200 may include R*L controllable filters (or W-filters) 218 between each of the accelerometer signals and each of the speakers. As an example, an RNC system having 12 accelerometer outputs (i.e., R=12) may employ 6 dual-axis accelerometers or 4 triaxial accelerometers. In the same example, a vehicle having 6 speakers (i.e., L=6) for reproducing anti-noise, therefore, may use 72 W-filters in total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

The ANC system 104 illustrated in FIG. 1 may also include an engine order cancellation (EOC) system. As mentioned above, EOC technology uses a non-acoustic signal such as an RPM signal representative of the engine speed as a reference in order to generate sound that is opposite in phase to the engine noise audible in the vehicle interior. Common EOC systems utilize a narrowband feed-forward ANC framework to generate anti-noise using an RPM signal to guide the generation of an engine order signal identical in frequency to the engine order to be cancelled, and adaptively filtering it to create an anti-noise signal. After being transmitted via a secondary path from an anti-noise source to a listening position or error microphone, the anti-noise ideally has the same amplitude, but opposite phase, as the combined sound generated by the engine and exhaust pipes and filtered by the primary paths that extend from the engine to the listening position and from the exhaust pipe outlet to the listening position. Thus, at the place where an error microphone resides in the vehicle cabin (i.e., most likely at or close to the listening position), the superposition of engine order noise and anti-noise would ideally become zero so that acoustic error signal received by the error microphone would only record sound other than the (ideally cancelled) engine order or orders generated by the engine and exhaust.

Commonly, a non-acoustic sensor, for example an RPM sensor, is used as a reference. RPM sensors may be, for example, Hall Effect sensors which are placed adjacent to a spinning steel disk. Other detection principles can be employed, such as optical sensors or inductive sensors. The signal from the RPM sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Figures 3, 4:
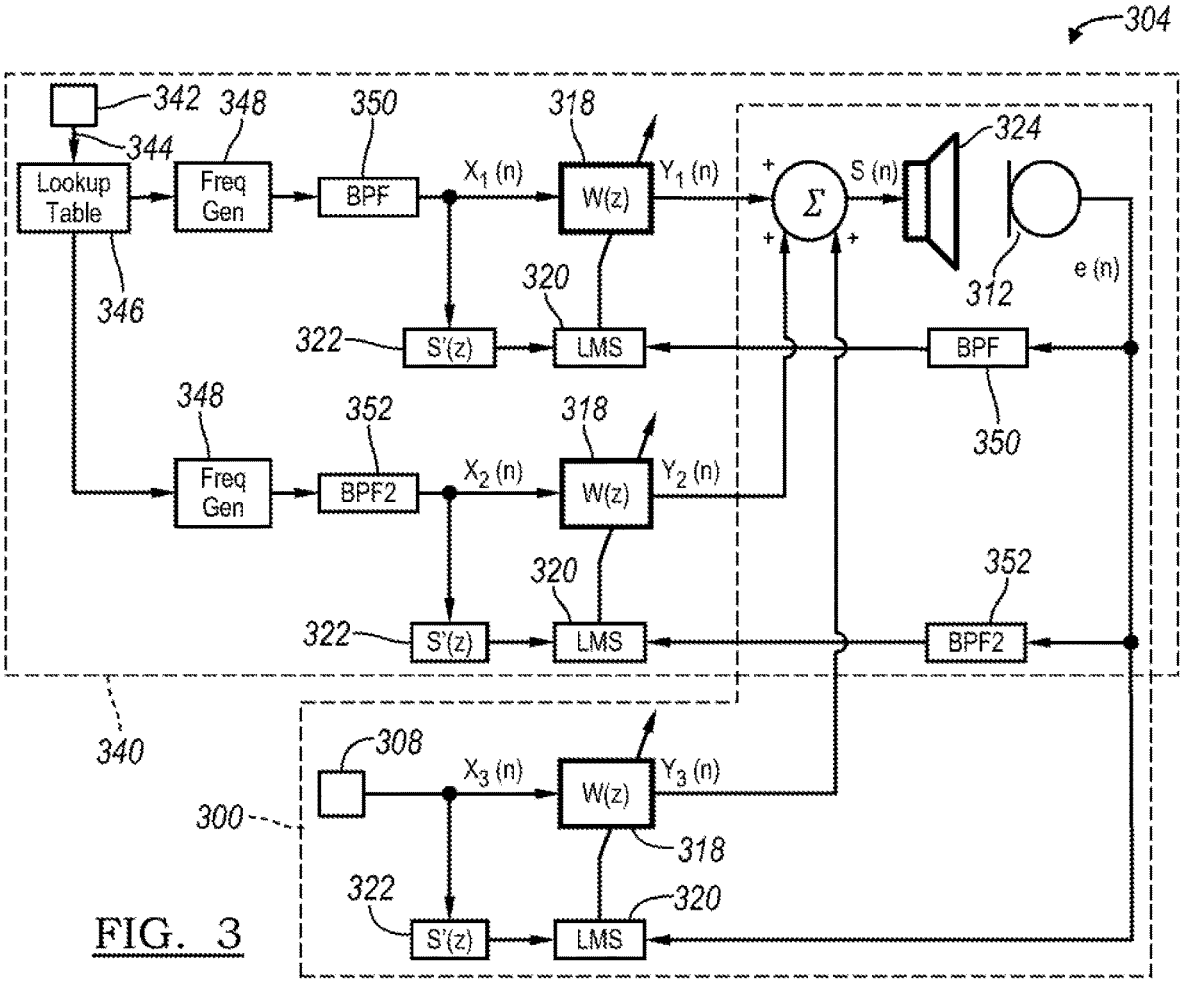
FIG. 3 is a sample schematic block diagram of an ANC system including an engine order cancellation (EOC) system and an RNC system.
FIG. 4 is a sample lookup table of frequencies of each engine order for a given RPM in an EOC system.

FIG. 3 is a schematic block diagram illustrating an example of an ANC system 304, including both an RNC system 300 and an EOC system 340. Similar to RNC system 100, the RNC system 300 may include elements 308, 312, 318, 320, 322, and 324, consistent with operation of elements 108, 112, 118, 120, 122, and 124, respectively, discussed above. The EOC system 340 may include an RPM sensor 342, which may provide an RPM signal 344 (e.g., a square-wave signal) indicative of rotation of an engine drive shaft or other rotating shaft indicative of the engine rotational speed. In some embodiments, the RPM signal 344 may be obtained from a vehicle network bus (not shown). As the radiated engine orders are directly proportional to the drive shaft RPM, the RPM signal 344 is representative of the frequencies produced by the engine and exhaust system. Thus, the signal from the RPM sensor 342 may be used to generate reference engine order signals corresponding to each of the engine orders for the vehicle. Accordingly, the RPM signal 344 may be used in conjunction with a lookup table 346 of RPM vs. Engine Order Frequency, which provides a list of engine orders radiated at each engine RPM.

FIG. 4 illustrates an example EOC cancellation tuning table 400, which may be used to generate lookup table 346. The example table 400 lists frequencies of each engine order for a given RPM. In the illustrated example, four engine orders are shown. The LMS algorithm takes as an input the RPM and generates a sine wave for each order based on this lookup table 400. As previously described, the relevant RPM for the table 400 may be drive shaft RPM.

Referring back to FIG. 3, the frequency of a given engine order at the sensed RPM, as retrieved from the lookup table 346, may be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 may be sent to an adaptive controllable filter 318, or W-filter, which provides a corresponding anti-noise signal Y(n) to the loudspeaker 324. As shown, various components of this narrow-band, EOC system 340 may be identical to the broadband RNC system 300, including the error microphone 312, adaptive filter controller 320 and secondary path filter 322. The anti-noise signal Y(n), broadcast by the speaker 324 generates anti-noise that is substantially out of phase but identical in magnitude to the actual engine order noise at the location of a listener's ear, which may be in close proximity to an error microphone 312, thereby reducing the sound amplitude of the engine order. Because engine order noise is narrow band, the error microphone signal e(n) may be filtered by a bandpass filter 350 prior to passing into the LMS-based adaptive filter controller 320. In an embodiment, proper operation of the LMS adaptive filter controller 320 is achieved when the noise signal X(n) output by the frequency generator 348 is bandpass filtered using the same bandpass filter parameters.

In order to simultaneously reduce the amplitude of multiple engine orders, the EOC system 340 may include multiple frequency generators 348 for generating a noise signal X(n) for each engine order based on the RPM signal 344. As an example, FIG. 3 shows a two order EOC system having two such frequency generators for generating a unique noise signal (e.g., $X_1(n)$, $X_2(n)$, etc.) for each engine order based on engine speed. Because the frequency of the two engine orders differ, the band pass filters 350 (labeled BPF and BPF2) have different high- and low-pass filter corner frequencies. The number of frequency generators and corresponding noise-cancellation components will ultimately vary based on the number of engine orders for a particular engine of the vehicle. As the two-order EOC system 340 is combined with the RNC system 300 to form ANC system 304, the anti-noise signals Y(n) output from the three controllable filters 318 are summed and sent to the speaker 324 as a speaker signal S(n). Similarly, the error signal e(n) from the error microphone 312 may be sent to the three LMS adaptive filter controllers 320.

One leading factor that can lead to instability or reduced noise cancellation performance in ANC systems occurs when a modeled transfer characteristic S'(z), representing an estimate of the secondary path, stored in the ANC system does not match the actual secondary path of the system. As previously discussed, the secondary path is the transfer function between an anti-noise generating speaker and an error microphone. Accordingly, it essentially characterizes how the electrical anti-noise signal Y(n) becomes sound that is radiated from the speaker, travels through the car cabin to the error microphone, and becomes part of the microphone output or error signal e(n) in the ANC system. According to one or more embodiments of the present disclosure, music or anti-noise played from the speakers and captured by the error microphones may be used to verify in real time that the stored estimate of the secondary paths (i.e., S'(z)) are an accurate representation of the actual secondary paths (i.e., S(z)).

Figure 5:
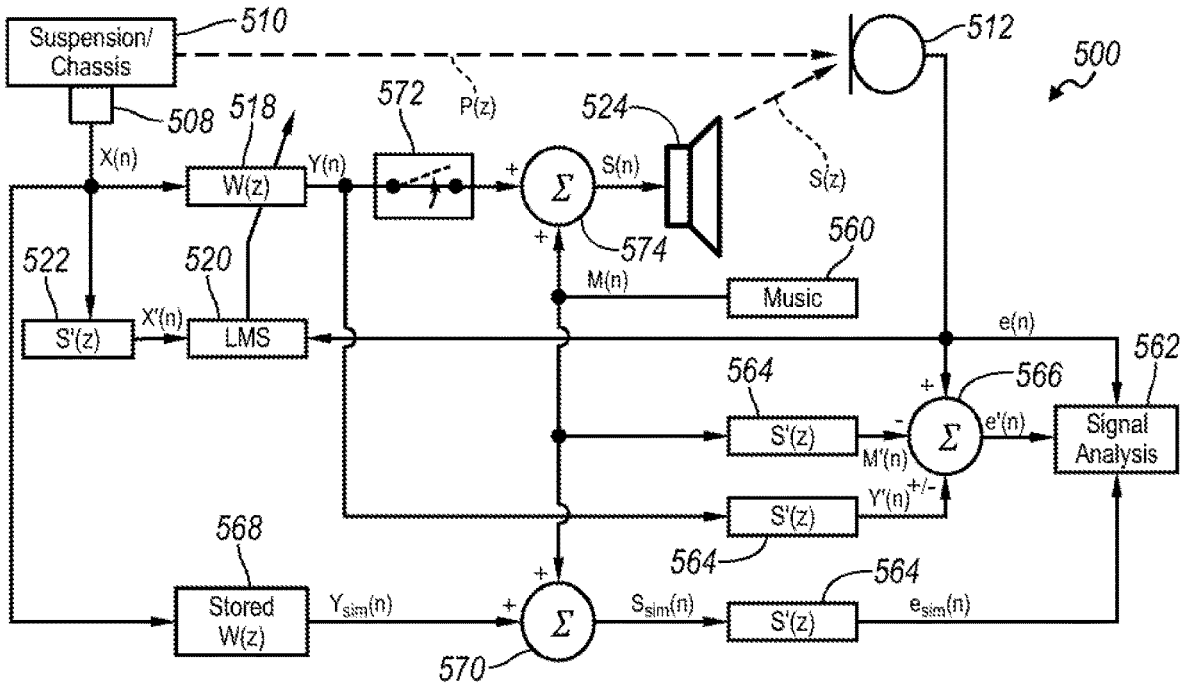
FIG. 5 is a schematic block diagram representing an ANC system including a signal analysis controller, in accordance with one or more embodiments of the present disclosure.

FIG. 5 is a schematic block diagram of a vehicle-based ANC system 500 showing many of the key ANC system parameters that may be used to verify the stored estimates of the secondary paths and optimize ANC system performance. For ease of explanation, the ANC system 500 illustrated in FIG. 5 is shown with components and features of an RNC system, such as RNC system 100. However, the ANC system 500 may include an EOC system such as shown and described in connection with FIG. 3. Accordingly, the ANC system 500 is a schematic representation of an RNC and/or EOC system, such as those described in connection with FIGS. 1-3, featuring additional system components. Similar components may be numbered using a similar convention. For instance, similar to RNC system 100, the ANC system 500 may include elements 508, 510, 512, 518, 520, 522, and 524, consistent with operation of elements 108, 110, 112, 118, 120, 122, and 124, respectively, discussed above. FIG. 5 also shows the primary path P(z) and secondary path S(z), as described with respect to FIG. 1, in block form for illustrative purposes.

Similar to FIG. 1, the noise signal X(n) from the noise input, such as vibration sensor 508, may be filtered with a modeled transfer characteristic S'(z), using stored estimates of the secondary path as previously described, by a secondary path filter 522 to obtain a filtered noise signal X'(n). Moreover, a transfer characteristic W(z) of a controllable filter 518 (e.g., a W-filter) may be controlled by LMS adaptive filter controller (or simply LMS controller) 520 to provide an adaptive filter. The noise signal, as filtered by the secondary path filter 522, and an error signal e(n) from the microphone 512 are inputs to the LMS adaptive filter controller 520. The anti-noise signal Y(n) may be generated by controllable filter 518 adapted by the LMS controller 520 based on the noise signal X(n).

The speaker 524 that produces anti-noise based on the anti-noise signal Y(n) may be the same speakers used for the playback of music. Accordingly, FIG. 5 shows that a music signal M(n) from a music playback device 560 may be combined with the anti-noise signal Y(n) into a speaker signal S(n) to be reproduced as sound by the speaker 524. As shown, the ANC system 500 may further include a signal analysis controller 562. The signal analysis controller 562 may include a processor and memory (not shown), such as processor 128 and storage 130, programmed to verify whether the stored estimate(s) of the secondary path S'(z) match the actual secondary path S(z) in a vehicle. This secondary path verification may be performed using estimates of the music and/or anti-noise, being radiated by the speaker 524, to the location of the microphone 512. Accordingly, the ANC system may include additional secondary path filters 564 to generate these estimates of the music or anti-noise. In particular, the anti-noise signal Y(n) may be filtered by the secondary path filter 564 to obtain an estimated anti-noise signal Y'(n), which provides an estimate of anti-noise at the location of the microphone 512. Similarly, the music signal M(n) may be filtered by a secondary path filter 564 to obtain an estimated music signal M'(n), which provides an estimate of music at the location of the microphone 512. The stored transfer characteristic modeled by the secondary path filters 564 may typically be the same as the stored transfer characteristic modeled in secondary path filter 522. For instance, the values of the secondary path filter 522 may be copied into the secondary path filters 564 in order to compute the estimated anti-noise signal Y'(n) and/or estimated music signal M'(n)

The actual error signal e(n) from the microphone 512 may be modified by one or both of the estimated anti-noise signal Y'(n) and the estimated music signal M'(n) at block 566 to obtain an adjusted error signal e'(n). For instance, when music is present in the error signal e(n), because it is being radiated by speaker 524, an estimate of the music at the microphone 512 (i.e., estimated music signal M'(n)) may be subtracted from the error signal e(n) to obtain the adjusted error signal e'(n). Similarly, when anti-noise is present (e.g., because the ANC system is active), an estimate of the anti-noise at the microphone 512 (i.e., estimated anti-noise signal Y'(n)) may be subtracted from the error signal e(n) to obtain the adjusted error signal e'(n).

According to another embodiment, the estimate of the secondary path may be verified when the ANC system is inactive by adding the estimated anti-noise signal Y'(n) to the error signal e(n) to obtain the adjusted error signal e'(n). In this case, it should be noted that with ANC off, the anti-noise signal Y(n) will not be delivered to the speaker 524 and introduced as actual anti-noise in the passenger cabin. For instance, a switch 572 may be introduced between the controllable filter 518 and summation block 574 to prevent the anti-noise signal Y(n) from reaching the summation block and be added to the music signal M(n) for output by the speaker 524.

The signal analysis controller 562 may then compare the error signal e(n) to the adjusted error signal e'(n) to determine if noise boosting or instability is occurring, as will be described in greater detail below. The presence of noise boosting, as detected by the signal analysis controller 562, may indicate that the modeled transfer characteristic S'(z) of the secondary path, applied by the secondary path filter 522, is inaccurate. Once noise boosting or instability is recognized, the ANC system may take corrective action by, for example, deactivating the ANC system 500, effectively deactivating any anti-noise adapted using the inaccurate secondary path filter 522 by preventing the associated anti-noise signal Y(n) from reaching speaker 524, or replacing the stored transfer characteristic of the secondary path filter 522 and 564 with a different modeled transfer characteristic of the secondary path between speaker 524 and microphone 512. Various techniques for mitigating the presence of noise boosting based on secondary path verification are described in greater detail below.

In another embodiment, the signal analysis controller 562 may validate the accuracy of the secondary path filter 522 using known good W-filter values stored by the ANC system 500. This technique may be employed after noise boosting has been detected using anti-noise as the detection signal to ascertain whether the boosting is due to an inaccurate controllable W-filter 518 or an inaccurate modeled transfer characteristic S'(z) stored in the secondary path filter 522. In this case, the noise signal X(n) may be convolved with a stored W-filter in block 568 to obtain a simulated anti-noise signal $Y_{sim}(n)$. The simulated anti-noise signal $Y_{sim}(n)$ may be optionally combined with the music signal M(n) at a block 570 to obtain a simulated speaker signal $S_{sim}(n)$. The simulated speaker signal $S_{sim}(n)$ may then be filtered or convolved with the stored estimate of the secondary path S'(z) using secondary path filter 564 to provide a simulated error signal $e_{sim}(n)$. The signal analysis controller 562 may then compare the error signal e(n) to the simulated error signal $e_{sim}(n)$ to provide an alternate check on whether the stored estimate of the secondary path S'(z) is an accurate representation of the actual secondary path S(z) or whether the noise boosting was simply from mis-adaptation of the controllable filter 518 (i.e., the W-filter). That is, if noise boosting is still detected using a known good W-filter stored in block 568, then it can be determined that a mis-adapted controllable filter 518 is the likely culprit.

Figure 6:
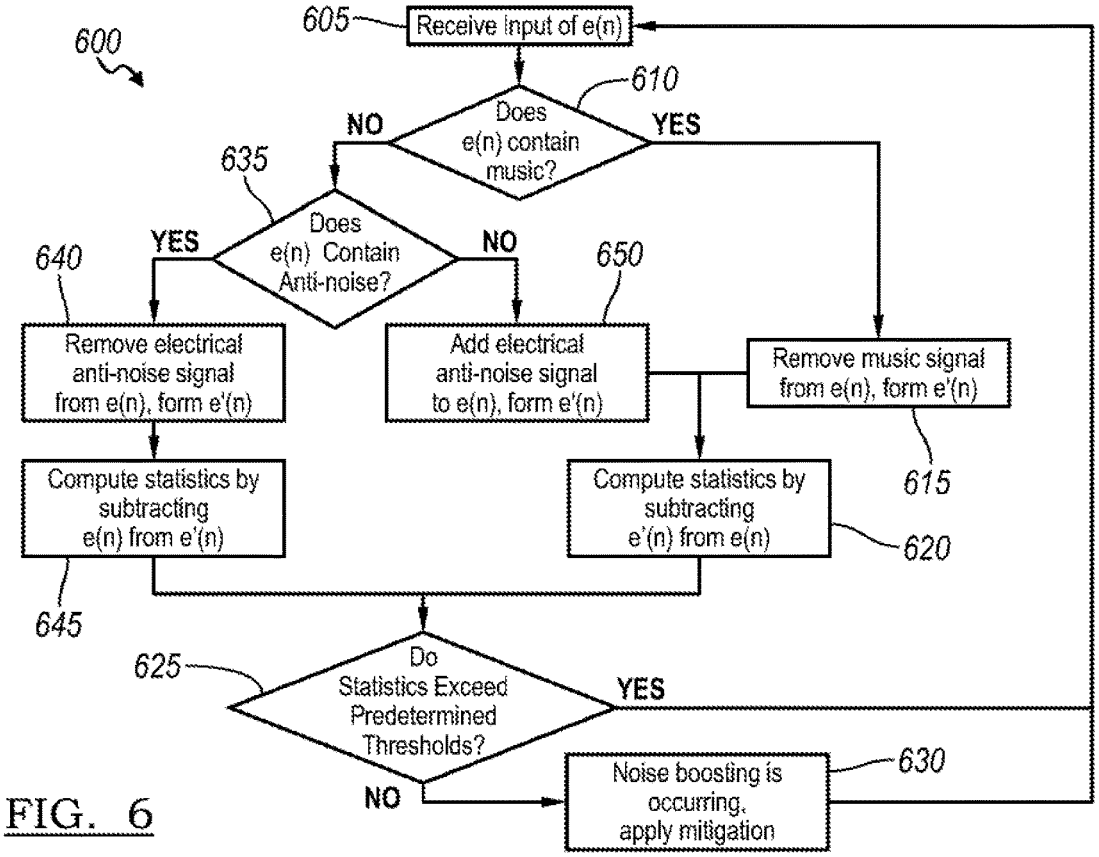
FIG. 6 is a flowchart depicting a method for verifying the accuracy of secondary path filters in an ANC system, in accordance with one or more embodiments of the present disclosure.

FIG. 6 is a flowchart depicting a method 600 for verifying that a stored estimate of the secondary path S'(z) is an accurate representation of the actual secondary path between a speaker and an error microphone in an ANC system. This may be achieved by acquiring an error microphone signal e(n) indicative of all the sounds in the passenger cabin at a particular location and either electrically adding or subtracting either anti-noise or music to create a second error signal (e.g., adjusted error signal e'(n)) to compare to the actual error signal e(n). Various steps of the disclosed method may be carried out by the signal analysis controller 562, either alone, or in conjunction with other components of the ANC system 500.

There are four potential cases to consider in which this secondary path verification process can be employed: (1) ANC off, music playback off; (2) ANC off, music playback on; (3) ANC on, music playback off; and (4) ANC on, music playback on. In the cases where the error signal e(n) includes traces of anti-noise because the ANC system is active, the accuracy of the stored secondary path S'(z) may be validated by removing the anti-noise component at the microphone 512 from the error signal e(n). In these cases, if the stored secondary path S'(z) is indicative of the actual secondary path S(z), then the subtraction (removal) of the anti-noise from the error signal e(n), thereby creating the adjusted error signal e'(n), should result in the adjusted error signal e'(n) having a higher amplitude at one or more frequencies (e.g., the frequencies contained within the estimated anti-noise signal Y'(n)) as compared to the error signal e(n). If any frequency range has a lower signal amplitude, it is because the stored secondary path S'(z) is not representative of the actual secondary path S(z) and has resulted in noise boosting.

In the cases where the error signal e(n) includes traces of music because the music playback device 560 is on, the accuracy of the stored secondary path S'(z) may be validated by removing the music component at the microphone 512 from the error signal e(n). For instance, if the stored secondary path S'(z) is indicative of the actual secondary path S(z), then the subtraction (removal) of the music from the error signal e(n), thereby creating the adjusted error signal e'(n), should result in the adjusted error signal e'(n) having a lower amplitude at one or more frequencies (e.g., the frequencies contained within the estimated music signal M'(n)) than the actual error signal e(n). If any frequency range has a higher signal amplitude, it is because the stored secondary path S'(z) is inaccurate and has resulted in noise boosting.

In the case where ANC is off, the error signal e(n) contains no anti-noise. Thus, the addition of an electrical anti-noise signal (i.e., the estimated anti-noise signal Y'(n)) to the error signal e(n), thereby forming the adjusted error signal e'(n), should likewise result in e'(n) having a lower signal amplitude at one or more frequencies (e.g., the frequencies contained within the estimated anti-noise signal Y'(n)) as compared to the original error signal e(n). If any frequency range has a higher signal amplitude, it may be because the stored secondary path S'(z) is not representative of the actual secondary path S(z).

When both music playback and ANC is on, the error signal e(n) from the microphones may contains traces of either of these sounds. Accordingly, either an estimate of the music or of the anti-noise at the microphone can be removed from the error signal e(n) to obtain the adjusted error signal e'(n). The proper comparison process described above may then be conducted depending on which sound component is removed.

The method 600 for verifying the accuracy of a stored estimate of the secondary path S'(z) may begin at a step 605 where the signal analysis controller 562 may receive the error signal e(n) from the microphone 512. At step 610, the system may determine whether the error signal e(n) contains music (i.e., whether the music playback device 560 is on and contributing to the sound sensed by the microphone 512). If the error signal e(n) contains music, the method may proceed to step 615 where the music component of the error signal e(n) is removed to obtain the adjusted error signal e'(n). As previously described, this may be achieved by convolving the music by the stored secondary path S'(z) (i.e., filtering the music signal M(n) using the secondary path filter 564) to generate the estimated music signal M'(n), which represents an estimate of the music at the location of microphone 512. The estimated music signal M'(n) may then be subtracted from the error signal e(n) to obtain the adjusted error signal e'(n).

The error signal e(n) may then be compared to the adjusted error signal e'(n) at step 620. If the stored secondary path S'(z) matches the actual secondary path S(z) of the vehicle well enough, the energy in the newly created adjusted error signal e'(n) should be lower than the energy in the error signal e(n) from the error microphone 512. In an embodiment, the signal analysis controller 562 may compute a frequency domain representation of both the error signal e(n) and the adjusted error signal e'(n) for this comparison. If the level of any frequency bin in the adjusted error signal e'(n) is higher than that of the error signal e(n), then the stored secondary path S'(z) and the actual secondary path S(z) do not match well enough at that frequency, and that any anti-noise created at this frequency is resulting (or may result) in noise gain instead of noise cancellation.

As part of the comparison at step 620, the signal analysis controller 562 may compute a difference between the error signal e(n) and the adjusted error signal e'(n) by subtracting the adjusted error signal e'(n) from the error signal e(n). This may likewise be executed in the frequency domain by calculating the differences between signal amplitudes in each frequency bin. The difference between the error signal e(n) and the adjusted error signal e'(n) may then be compared to a predetermined threshold, as provided at step 625. Noise boosting may therefore be detected when energy in the error signal e(n) does not exceed energy in the adjusted error signal e'(n) by the predetermined threshold. Stated differently, noise boosting may be detected when the result from subtracting the adjusted error signal e'(n) from the error signal e(n) is less than the predetermined threshold.

If it is determined that noise boosting is occurring, one or more techniques may be employed to reduce or reverse the noise boosting and/or the stabilize the ANC system, as provided at step 630. These mitigation techniques will be described in greater detail below. Returning to step 625, if the difference computed at step 620 exceeds the predetermined threshold, it may be determined that the stored secondary path S'(z) adequately matches the actual secondary path S(z), such that the adaptive filter controller 520 will properly update controllable filters 518 and no noise boosting will occur in the ANC system. Accordingly, the method may return to step 605 to continue to verify the accuracy of the secondary path filters.

If at step 610, it is determined that the error signal does not contain a music playback component, or if secondary path verification using anti-noise is preferred, the method may proceed to step 635. At step 635, the signal analysis controller may determine whether the error signal e(n) contains anti-noise. For instance, if ANC is not active, then the error signal e(n) will not pick up any anti-noise at the microphone 512. If, however, ANC is active, then the signal analysis controller 562 may determine that the error signal e(n) does indeed contain anti-noise radiated by the speaker 524. If the error signal e(n) contains anti-noise, the method may proceed to step 640 where the anti-noise component of the error signal e(n) is removed to obtain the adjusted error signal e'(n). As previously described, this may be achieved by convolving the anti-noise by the stored secondary path S'(z) (i.e., filtering the anti-noise signal Y(n) using the secondary path filter 564) to generate the estimated anti-noise signal Y'(n), which represents an estimate of the anti-noise at the location of microphone 512. The estimated anti-noise signal Y'(n) may then be subtracted from the error signal e(n) to obtain the adjusted error signal e'(n).

The error signal e(n) may then be compared to the adjusted error signal e'(n) at step 645. If the stored secondary path S'(z) matches the actual secondary path S(z) of the vehicle well enough, the energy in the newly created adjusted error signal e'(n) should in this case be higher than the energy in the error signal e(n) from the error microphone 512. In an embodiment, the signal analysis controller 562 may compute a frequency domain representation of both the error signal e(n) and the adjusted error signal e'(n) for this comparison. If the level of any frequency bin in the adjusted error signal e'(n) is lower than that of the error signal e(n), then the stored secondary path S'(z) and the actual secondary path S(z) do not match well enough at that frequency, and that any anti-noise created at this frequency is resulting (or may result) in noise gain instead of noise cancellation.

As part of the comparison at step 645, the signal analysis controller 562 may compute a difference between the error signal e(n) and the adjusted error signal e'(n) by subtracting the error signal e(n) from the adjusted error signal e'(n). This may likewise be executed in the frequency domain by calculating the differences between signal amplitudes in each frequency bin. The difference between the error signal e(n) and the adjusted error signal e'(n) may then be compared to a predetermined threshold, as provided at step 625. In this case, noise boosting may therefore be detected when energy in the adjusted error signal e'(n) does not exceed energy in the error signal e(n) by the predetermined threshold. Stated differently, noise boosting may be detected when the result from subtracting error signal e(n) from the adjusted error signal e'(n) is less than the predetermined threshold. Again, if noise boosting is detected, the method may proceed to step 630 to apply noise boosting mitigation.

If at step 635 the error signal e(n) does not contain anti-noise (e.g., ANC is effectively off), the method may proceed to step 650 where an estimate of anti-noise may be added to the error signal e(n) to obtain the adjusted error signal e'(n). As previously described, this may be achieved by filtering an anti-noise signal Y(n) using the secondary path filter 564 to generate an estimated anti-noise signal Y'(n), which represents an estimate of anti-noise at the location of microphone 512. In this case, it should be noted that with ANC off, the anti-noise signal Y(n) will not be delivered to the speaker 524 and introduced as actual anti-noise in the passenger cabin. As previously described, switch 572 may be introduced between the controllable filter 518 and summation block 574 to prevent the anti-noise signal Y(n) from reaching the summation block and be added to the music signal M(n) for output by the speaker 524. The estimated anti-noise signal Y'(n) may then be added to the error signal e(n) to obtain the adjusted error signal e'(n). The error signal e(n) may then be compared to the adjusted error signal e'(n) at step 620, as previously described. That is, if the stored secondary path S'(z) matches the actual secondary path S(z) of the vehicle well enough, the energy in the newly created adjusted error signal e'(n) should be lower than the energy in the error signal e(n) from the error microphone 512. In an embodiment, the signal analysis controller 562 may compute a frequency domain representation of both the error signal e(n) and the adjusted error signal e'(n) for this comparison. If the level of any frequency bin in the adjusted error signal e'(n) is higher than that of the error signal e(n), then the stored secondary path S'(z) and the actual secondary path S(z) do not match well enough at that frequency, and that any anti-noise created at this frequency is resulting (or may result) in noise gain instead of noise cancellation.

Again, as part of the comparison at step 620, the signal analysis controller 562 may compute a difference between the error signal e(n) and the adjusted error signal e'(n) by subtracting the adjusted error signal e'(n) from the error signal e(n). This may likewise be executed in the frequency domain by calculating the differences between signal amplitudes in each frequency bin. The difference between the error signal e(n) and the adjusted error signal e'(n) may then be compared to a predetermined threshold, as provided at step 625. Noise boosting may therefore be detected when energy in the error signal e(n) does not exceed energy in the adjusted error signal e'(n) by the predetermined threshold. Stated differently, noise boosting may be detected when the result from subtracting the adjusted error signal e'(n) from the error signal e(n) is less than the predetermined threshold.

As previously explained, the ANC system 500 may be scaled to include multiple noise signals X(n) (both RNC and EOC), speakers 524, and error microphones 512. Moreover, there exists one secondary path S(z) between each error microphone 512 and each speaker 524. Thus, for example, a four-microphone, six-speaker ANC system will have 24 secondary path filters (4×6=24). In a multiple speaker system, each microphone 512 detects the output from each speaker 524. Thus, in the aforementioned example, a microphone's error signal e(n) may consist of contributions of the primary path noise P(z) plus the contribution of six different anti-noise Y(n) signals that travel on the six different secondary paths S(z) paths to the microphone. In an embodiment, the accuracy of individual secondary path filters may be verified through progressive processing of the steps described above. For instance, in the example, each of the six anti-noise signals Y(n) may be subtracted individually from the error signal e(n) of a microphone 512, and the energy differencing step may be repeated for each iteration in an effort to detect noise boosting. This will determine any and all secondary path filter estimates S'(z) filters that are contributing to the noise addition or instability, and so do not match the actual secondary paths accurately enough.

If it is determined that noise boosting is occurring, one or more techniques may be employed to reduce or reverse the noise boosting and/or the stabilize the ANC system, as provided at step 630. For example, the ANC system 500 may be deactivated altogether, effectively deactivating any anti-noise adapted using the inaccurate secondary path filter 522 by preventing the associated anti-noise signal Y(n) from reaching speaker 524. Techniques to prevent the associated anti-noise signal Y(n) from reaching the speaker 524 may include replacement of the stored transfer characteristics of secondary path filter 522 with zeros, replacement of the stored W(z) filter in block 568 with zeros, reduction of the gain of an amplifier channel associated with the speaker 524, or the like. Lowering the value of any of these filters or amplifiers by even 10 dB may be sufficient to render the anti-noise generated by the speaker 524 to have a negligible effect on the soundscape at the microphone 512, thereby reducing any boosting or instability to inaudible levels. Alternatively, individual secondary path filters that are contributing to the noise boosting or instability may be deactivated or zeroed. In an embodiment, all the secondary path filters related to a particular speaker can be deactivated. In another embodiment, the secondary path filters that are contributing to the noise boosting can be replaced or updated with estimates of the secondary path S'(z) stored in secondary path filters that do not boost the noise level in the passenger cabin, as determined at step 625.

As described, embodiments of the aforementioned method are possible using either a music signal M(n), an anti-noise signal Y(n), or a combination of both signals. When the speaker signal S(n) sent to the loudspeaker 524 consists only of music, the above process may subtract only music off the error signal e(n) to allow the signal analysis controller 562 to predict the presence of noise boosting. When the speaker signal S(n) sent to the loudspeaker 524 consists only of anti-noise, the above process may subtract only anti-noise from the error signal e(n) to allow the signal analysis controller 562 to detect the presence of noise boosting. Because the secondary path S(z) may be signal amplitude S(z) dependent, multiple estimates of the secondary path S'(z) may be stored and used as a set to achieve the most accurate prediction of the presence of noise boosting. For example, the anti-noise signal Y(n) typically has a lower amplitude than music signal M(n) because the level of typical road noise is lower than the typical level at which occupants listen to music. In an embodiment, a set of secondary path estimates S'(z) at various levels are stored and used as a set wherein a lower playback amplitude S'(z) is used in the secondary path filter 522 while a higher playback amplitude S'(z) is used in the secondary path filter 564 to generate the estimated music signal M'(z). If boosting is detected in step 625, a new set of stored secondary path estimates, S'(z), are substituted in the secondary path filters 522 and 564. It is also worth noting that typical music or anti-noise does not contain energy at every frequency in each analysis frame. Therefore, in an embodiment, some averaging of FFT frames may be required to provide a reliable analysis by the signal analysis controller 562 of the entire noise cancellation frequency range when comparing error signals e(n) to adjusted error signals e'(n).

In an embodiment, additional thresholding can augment the detection of noise boosting due to S'(z) vs. S(z) mismatch. Note that when using a music signal to determine boosting, the level of the music may typically be set such that it is 20 dB louder than the level of the sum of all of the other sources of background noises (e.g. speech, road noise, engine noise), thereby achieving a 20 dB signal-to-noise ratio (SNR). In this case, a significant reduction (e.g., as much as 10 dB or more) in level of the adjusted error signal e'(n) relative to the error signal e(n) can be computed when subtracting the estimated music signal M'(n) from the error signal e(n). This significant reduction is possible because the estimated music signal M'(n) is a dominant contributor to the error signal e(n), as it is 20 dB louder than the sum of all other contributors to the error signal e(n). The total reduction level may be less if the music playback is set to a level 20 dB quieter than the sum of all other sounds in the vehicle, thereby achieving a −20 dB SNR. In this case, the subtraction of the estimated music signal M'(n) from the error signal e(n) will only produce an adjusted error signal e'(n) that may only be 1 dB lower in level than the error signal e(n). In an embodiment, the relative levels of the error signal e(n), the estimated music signal M'(n), and the estimated anti-noise signal Y'(n) can be used to dynamically compute an SNR that increases or decreases the threshold used to determine if boosting is detected. In an embodiment, thresholds are stored for more than one SNR for either or both of the estimated music signal M'(n) and the estimated anti-noise Y'(n).

Although FIGS. 1, 3, and 5 show LMS-based adaptive filter controllers 120, 320, and 520, respectively, other methods and devices to adapt or create optimal controllable W-filters 118, 318, and 518 are possible. For example, in one or more embodiments, neural networks may be employed to create and optimize W-filters in place of the LMS adaptive filter controllers. In other embodiments, machine learning or artificial intelligence may be used to create optimal W-filters in place of the LMS adaptive filter controllers.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for controlling stability in an active noise cancellation (ANC) system, the method comprising:

receiving an error signal from a microphone;

generating a speaker signal to be radiated from a speaker, the speaker signal including at least a music signal;

filtering the music signal using a secondary path filter to obtain an estimated music signal, the secondary path filter defined by a stored transfer characteristic that estimates a secondary path between the speaker and the microphone;

modifying the error signal using the estimated music signal to obtain an adjusted error signal by subtracting the estimated music signal from the error signal to obtain the adjusted error signal when the error signal contains music; and detecting an occurrence of noise boosting based on a comparison of the error signal to the adjusted error signal.

2. The method of claim 1, wherein detecting an occurrence of noise boosting based on a comparison of the error signal to the adjusted error signal comprises detecting the occurrence of noise boosting when energy in the adjusted error signal exceeds energy in the error signal.

3. The method of claim 1, wherein detecting an occurrence of noise boosting based on a comparison of the error signal to the adjusted error signal comprises detecting the occurrence of noise boosting when energy in the error signal does not exceed energy in the adjusted error signal by a predetermined threshold.

4. The method of claim 1, wherein the speaker signal further comprises an anti-noise signal.

5. The method of claim 1, further comprising:

deactivating the speaker signal in response to detecting an occurrence of noise boosting.

6. The method of claim 1, wherein the secondary path filter is further used to filter a noise signal from a sensor to obtain a filtered noise signal, wherein an adaptive filter controller is configured to control an adaptive transfer characteristic based on the filtered noise signal and the error signal, and wherein a controllable filter is configured to generate an anti-noise signal based on the adaptive transfer characteristic and the noise signal, the method further comprising:

deactivating the anti-noise signal in response to detecting an occurrence of noise boosting.

7. The method of claim 1, wherein the secondary path filter is further used to filter a noise signal from a sensor to obtain a filtered noise signal, the method further comprising:

modifying the stored transfer characteristic in the secondary path filter in response to detecting an occurrence of noise boosting.

8. The method of claim 7, wherein modifying the stored transfer characteristic includes substituting the stored transfer characteristic with another transfer characteristic that provides a different estimate of the secondary path between the speaker and the microphone.

9. A computer-program product embodied in a non-transitory computer readable medium that is programmed for active noise cancellation (ANC), the computer-program product comprising instructions for:

receiving an error signal from a microphone;

receiving a noise signal from a sensor;

filtering the noise signal using a first secondary path filter to obtain a filtered noise signal, the first secondary path filter defined by a stored transfer characteristic that estimates a secondary path between a speaker and the microphone;

controlling filter coefficients of a controllable filter based on the filtered noise signal and the error signal;

generating an anti-noise signal to be radiated from the speaker based on the noise signal and the filter coefficients;

filtering a music signal using a second secondary path filter to obtain an estimated music signal, the second secondary path filter being a copy of the first secondary path filter;

subtracting the estimated music signal from the error signal to obtain an adjusted error signal; and detecting an occurrence of noise boosting based on a comparison of the error signal to the adjusted error signal.

10. The computer-program product of claim 9, further comprising instructions for:

disabling the anti-noise signal from being radiated by the speaker in response to detecting an occurrence of noise boosting.

11. The computer-program product of claim 9, further comprising instructions for:

modifying the stored transfer characteristic in the first secondary path filter in response to detecting an occurrence of noise boosting.

12. The computer-program product of claim 9, further comprising instructions for:

filtering the anti-noise signal using the second secondary path filter to obtain an estimated anti-noise signal; and subtracting the estimated anti-noise signal from the error signal to obtain the adjusted error signal.

* * * * *